US011346197B2

(12) United States Patent
Stephenson et al.

(10) Patent No.: US 11,346,197 B2
(45) Date of Patent: May 31, 2022

(54) ENHANCING SUBTERRANEAN FORMATION STIMULATION AND PRODUCTION USING TARGET DOWNHOLE WAVE SHAPES

(71) Applicant: Halliburton Energy Services, Inc., Houston, TX (US)

(72) Inventors: Stanley Vernon Stephenson, Duncan, OK (US); Philip D. Nguyen, Houston, TX (US); Jim Basuki Surjaatmadja, Duncan, OK (US); Norman Raymond Warpinski, Cypress, TX (US); Ronald Glen Dusterhoft, Katy, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 600 days.

(21) Appl. No.: 16/332,739

(22) PCT Filed: Dec. 13, 2016

(86) PCT No.: PCT/US2016/066276
§ 371 (c)(1),
(2) Date: Mar. 12, 2019

(87) PCT Pub. No.: WO2018/111231
PCT Pub. Date: Jun. 21, 2018

(65) Prior Publication Data

US 2021/0277760 A1 Sep. 9, 2021

(51) Int. Cl.
*E21B 43/26* (2006.01)
*E21B 47/06* (2012.01)
(Continued)

(52) U.S. Cl.
CPC ..... *E21B 43/2607* (2020.05); *E21B 47/06* (2013.01); *F04B 23/04* (2013.01);
(Continued)

(58) Field of Classification Search
CPC ..... E21B 43/26; E21B 43/2607; E21B 47/06; F04B 17/03; F04B 17/06;
(Continued)

(56) References Cited

U.S. PATENT DOCUMENTS 6,585,049 B2 7/2003 Leniek, Sr.
6,724,687 B1 4/2004 Stephenson et al.
(Continued)

OTHER PUBLICATIONS

"Pressure Changes White Fracturing Add to Marcellus Well Production," Stephen Rassenfoss, JPT Emerging Technology Senior Editor, JPT, Apr. 2016, SPE179107, pp. 36-37.
(Continued)

*Primary Examiner* — James G Sayre
(74) *Attorney, Agent, or Firm* — McGuireWoods LLP

(57) ABSTRACT

The embodiments herein relate generally to subterranean formation operations and, more particularly, systems and methods for achieving target downhole pressures having target downhole wave shapes for enhancement of subterranean formation stimulation and production. In particular, a treatment fluid is introduced into a subterranean formation and a downhole pressure wave in the subterranean formation having a downhole wave shape is determined, and a surface pressure wave having a surface wave shape is determined. The downhole wave shape and the surface wave shape are compared, followed by adjustment of the surface pressure to achieve a target downhole pressure wave in the subterranean formation having a target downhole wave shape. The target downhole pressure and target downhole wave shape may be selected to maximize production of the subterranean formation.

20 Claims, 4 Drawing Sheets

(51) Int. Cl.
*F04B 23/04* (2006.01)
*F04B 49/08* (2006.01)

(52) U.S. Cl.
CPC ..... *F04B 49/08* (2013.01); *F04B 2201/0201* (2013.01); *F04B 2207/02* (2013.01)

(58) Field of Classification Search
CPC ..... F04B 2201/0201; F04B 2207/02; F04B 23/04; F04B 23/06; F04B 47/00; F04B 49/08; F04B 53/10; F04B 9/02; F04B 9/10
See application file for complete search history.

(56) References Cited

U.S. PATENT DOCUMENTS

| | | | | |
|---|---|---|---|---|
| 7,100,688 | B2 | 9/2006 | Stephenson et al. | |
| 8,590,614 | B2 | 11/2013 | Surjaatmadja et al. | |
| 9,057,261 | B2 | 6/2015 | Walters et al. | |
| 2004/0023812 | A1 | 2/2004 | England et al. | |
| 2004/0208495 | A1 | 10/2004 | Lehman et al. | |
| 2007/0007003 | A1* | 1/2007 | Jackson | E21B 43/006 166/244.1 |
| 2009/0294121 | A1* | 12/2009 | Leon | E21B 43/2405 166/248 |
| 2011/0067885 | A1 | 3/2011 | Shampine et al. | |
| 2013/0039780 | A1 | 2/2013 | Lane | |
| 2016/0053611 | A1* | 2/2016 | Moos | E21B 43/263 166/250.1 |
| 2016/0061016 | A1 | 3/2016 | Ciezobka et al. | |
| 2016/0123127 | A1 | 5/2016 | Walls | |
| 2016/0356127 | A1 | 12/2016 | Dykstra et al. | |

OTHER PUBLICATIONS

Ciezobka, et al., "Variable Pump Rate Fracturing Leads to Improved Production in the Marcellus Shale," presented at SPE Hydraulic Fracturing Technology Conference, Feb. 9-11, 2016, The Woodlands, TX, USA, SPE-179107-MS, pp. 1-11.

International Search Report & Written Opinion issued for corresponding International Application No. PCT/US2016/066276 dated Aug. 23, 2017. (11 pages).

* cited by examiner

ENHANCING SUBTERRANEAN FORMATION STIMULATION AND PRODUCTION USING TARGET DOWNHOLE WAVE SHAPES

BACKGROUND

The embodiments herein relate generally to subterranean formation operations and, more particularly, systems and methods for achieving target downhole pressures having target downhole wave shapes for enhancement of subterranean formation stimulation and production.

Hydrocarbon producing wells (e.g., oil producing wells, gas producing wells, and the like) are often stimulated by hydraulic fracturing treatments. In traditional hydraulic fracturing treatments, a treatment fluid, sometimes called a carrier fluid in cases where the treatment fluid carries particulates entrained therein, is pumped into a portion of a subterranean formation (which may also be referred to herein simply as a "formation") above a fracture gradient sufficient to break down the formation and create one or more fractures therein. The term "treatment fluid," as used herein, refers generally to any fluid that may be used in a subterranean application in conjunction with a desired function and/or for a desired purpose. The term "treatment fluid" does not imply any particular action by the fluid or any component thereof. As used herein, the term "fracture gradient" refers to a pressure necessary to create or enhance at least one fracture in a particular subterranean formation location, increasing pressure within a formation may be achieved by placing fluid therein at a high flow rate.

Typically, particulate solids are suspended in a portion of the treatment fluid or in a secondary treatment fluid and deposited into the fractures. The particulate solids, known as "proppant particulates" or simply "proppant" serve to prevent the fractures from fully closing once the hydraulic pressure is removed. By keeping the fractures from fully closing, the proppant form a proppant pack having interstitial spaces that act as conductive paths through which fluids produced from the formation may flow. As used herein, the term "proppant pack" refers to a collection of proppant in a fracture, thereby forming a "propped fracture." The degree of success of a stimulation operation depends, at least in part, upon the ability of the proppant pack to permit the flow of fluids through the interconnected interstitial spaces between proppant while maintaining open the fracture.

The complexity of a fracture network (or "network complexity") may be enhanced by stimulation operations to create new or enhance existing (e.g., elongate or widen) fractures, which may be interconnected. As used herein, the term "fracture network" refers to the access conduits, either natural or man-made or otherwise, within a subterranean formation that are in fluid communication with a wellbore penetrating the formation. The "complexity" of a fracture network refers to the amount of access conduits, man-made or otherwise, within a subterranean formation that are in fluid communication with a wellbore; the greater the amount of access conduits, the greater the complexity. A fracture network with enhanced complexity may increase the amount of produced fluids that may be recovered from a particular subterranean formation.

BRIEF DESCRIPTION OF THE DRAWINGS

The following figures are included to illustrate certain aspects of the embodiments described herein, and should not be viewed as exclusive embodiments. The subject matter disclosed is capable of considerable modifications, alterations, combinations, and equivalents in form and function, as will occur to those skilled in the art and having the benefit of this disclosure.

DETAILED DESCRIPTION

Figure 1:
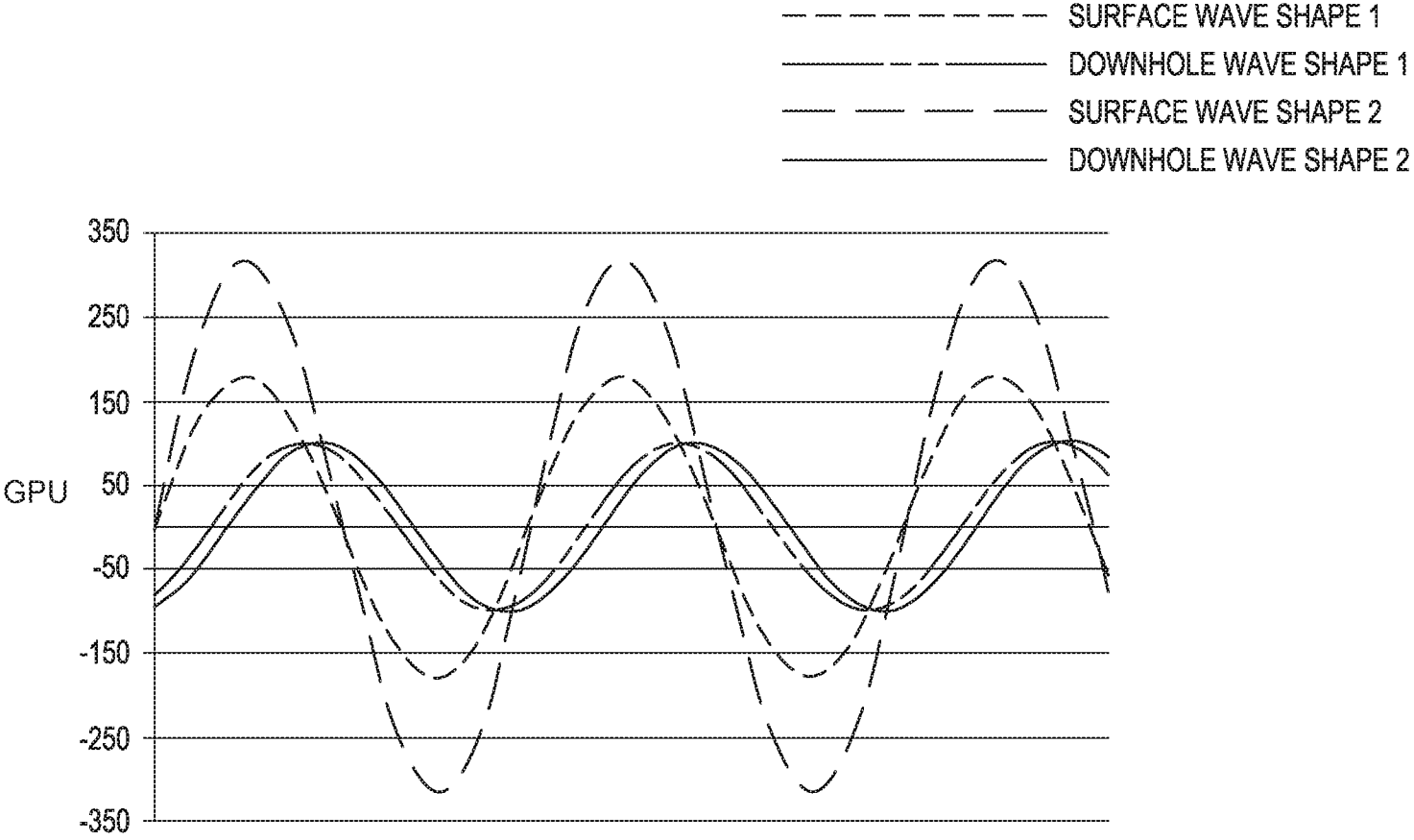
FIG. 1 illustrates a graphical representation of the impact of increasing fracture volume on sinusoidally surface and downhole pressure wave shape amplitudes, according to one or more embodiments of the present disclosure.

The embodiments herein relate generally to subterranean formation operations and, more particularly, systems and methods for achieving target downhole pressures having target downhole waves and wave shapes for enhancement of subterranean formation stimulation and production.

One or more illustrative embodiments disclosed herein are presented below. Not all features of an actual implementation are described or shown in this application for the sake of clarity. It is understood that in the development of an actual embodiment incorporating the embodiments disclosed herein, numerous implementation-specific decisions must be made to achieve the developer's goals, such as compliance with system-related, lithology-related, business-related, government-related, and other constraints, which vary by implementation and from time to time. While a developer's efforts might be complex and time-consuming, such efforts would be, nevertheless, a routine undertaking for those of ordinary skill in the art having benefit of this disclosure.

It should be noted that when "about" is provided herein at the beginning of a numerical list, the term modifies each number of the numerical list. In some numerical listings of ranges, some lower limits listed may be greater than some upper limits listed. One skilled in the art will recognize that the selected subset will require the selection of an upper limit in excess of the selected lower limit. Unless otherwise indicated, all numbers expressing quantities of ingredients, properties such as molecular weight, reaction conditions, and so forth used in the present specification and associated claims are to be understood as being modified in all instances by the term "about." As used herein, the term "about" encompasses +/−5% of a numerical value. For example, if the numerical value is "about 5," the range of 4.75 to 5.25 is encompassed. Accordingly, unless indicated to the contrary, the numerical parameters set forth in the following specification and attached claims are approximations that may vary depending upon the desired properties sought to be obtained by the exemplary embodiments described herein. At the very least, and not as an attempt to limit the application of the doctrine of equivalents to the scope of the claim, each numerical parameter should at least be construed in light of the number of reported significant digits and by applying ordinary rounding techniques.

While compositions and methods are described herein in terms of "comprising" various components or steps, the compositions and methods can also "consist essentially of" or "consist of" the various components and steps. When "comprising" is used in a claim, it is open-ended.

As used herein, the term "substantially" means largely, but not necessarily wholly.

The use of directional terms such as above, below, upper, lower, upward, downward, left, right, uphole, downhole and the like are used in relation to the illustrative embodiments as they are depicted in the figures herein, the upward direction being toward the top of the corresponding figure and the downward direction being toward the bottom of the corresponding figure, the uphole direction being toward the surface of the well and the downhole direction being toward the toe of the well. Additionally, the embodiments depicted in the figures herein are not necessarily to scale and certain features are shown in schematic form only or are exaggerated or minimized in scale in the interest of clarity.

The embodiments of the present disclosure maximize the effect of pressure changes during, without limitation, a stimulation operation such as a fracturing operation in a subterranean formation wellbore (e.g., an oil-producing wellbore, a gas-producing wellbore, or a geothermal wellbore). The effect of such pressure changes is maximized by adjusting surface pressures (e.g., rates) to affect downhole pressures, such as by maintaining constant downhole pressure or altering downhole pressure (e.g., stress variations) to achieve desired results. For example, the embodiments described herein may be used to achieve target downhole pressures to increase fracture complexity and connectivity, maximize constant surface area with formation matrix, and the like, to increase production rates and/or decrease production decline. The surface pressures and downhole pressures may be represented by certain wave shapes (also referred to herein as "pressure wave shapes") that can be compared and used to make decisions related to the desired downhole pressure, for example.

More particularly, in one or more embodiments of the present disclosure, a method is provided of introducing a treatment fluid through a wellhead and into a subterranean formation at a surface pressure above a fracture gradient of the subterranean formation to create or enhance at least one fracture therein at a first target interval. A downhole pressure wave is determined in the subterranean formation, where the downhole pressure wave has a certain downhole wave shape. The downhole pressure wave may be determined using a monitor or other sensor, or by modeling software based on the particular characteristics of the operation and subterranean formation, without departing from the scope of the present disclosure. Other means may be used to calculate the downhole pressure wave and wave shape, without departing from the scope of the present disclosure (e.g., reliance on similarly measured or modeled wellbores). A surface pressure wave at the surface location is also determined, where the surface pressure wave has a certain surface wave shape. The order in which the downhole and surface pressure wave is determined is non-limiting and either one may be determined first or they may be determined simultaneously, without departing from the scope of the present disclosure. The downhole and surface wave shapes are compared and the surface pressure at the surface location is adjusted to achieve a target downhole pressure wave, where the target downhole pressure wave has a target downhole wave shape.

As used herein, the term "surface pressure," and grammatical variants thereof, refers to a fluid pressure measured at or near a surface location of a wellbore in a subterranean formation (e.g., at or near a wellhead) as fluid is introduced into the wellbore. The surface pressure may be affected by altering the pressure at which the treatment fluid at the surface location is introduced into the subterranean formation, such as by adjusting the pump rate thereof or supplying pressure pulses, for example. The term "surface location," and grammatical variants thereof, as used herein, refers to any location at or above a wellhead in a drilling and/or production system, whether the wellhead is located on the earth's surface above or below sea. The term "surface location" does not imply contact with the surface of the earth or ground level, but a location conveniently accessible at a wellhead for performing certain actions related to or in preparation of acquisition of produced fluids. For example, the "surface location" may be about 15 meters (or about 50 feet) below the earth's surface, without departing from the scope of the present disclosure. The term "pressure pulse," and grammatical variants thereof, refers to a temporary modification of pressure, such as by increasing it, or decreasing it, or both.

As used herein, the term "surface pressure wave," and grammatical variants thereof, refers to a wave signal that propagates from a point at a surface location in a treatment fluid. The "surface wave shape," and grammatical variants thereof, as used herein, refers to the waveform (i.e., the contours of the wave) represented or propagated by a surface pressure wave. Similarly, the term "downhole pressure wave," and grammatical variants described herein, refers to a wave signal that propagates from a point downhole of a surface location in a treatment fluid; the term "downhole wave shape," as used herein, and grammatical variants thereof, refers to the waveform (i.e., the contours of the wave) represented or propagated by a downhole pressure wave. The "target" downhole pressure waves and shapes are defined herein as the desired downhole pressure wave and shape to achieve a particular desired outcome (e.g., increased fracture growth, increased fracture complexity, and the like, and any combination thereof).

In some embodiments, the method of determining the downhole pressure wave having a downhole wave shape and determining the surface pressure wave having a surface wave shape (determined in any order), comparing the downhole pressure wave shape and the surface pressure wave shape, and adjusting the surface pressure at the surface location to achieve the target downhole pressure wave having the target downhole wave shape is repeated at least once (including 2, 3, and an indefinite number of times during an operation) in the same interval. In other embodiments, the process of determining the downhole pressure wave having a downhole wave shape and determining the surface pressure wave having a surface wave shape (determined in any order), comparing the downhole pressure wave shape and the surface pressure wave shape, and adjusting the surface pressure at the surface location to achieve the target downhole pressure wave having the target downhole wave shape is repeated at least once (including 2, 3, and an indefinite number of times during an operation) at a second target interval within a subterranean formation. In some embodiments, when a second target interval is treated according to the embodiments of the present disclosure, it is first fractured by introducing a treatment fluid into the subterranean formation (e.g., through a wellhead and into a wellbore) at a surface pressure above the fracture gradient to create or enhance at least one fracture in the second target interval. Whether repeated at the first interval or at a second interval, in some embodiments, the repetition may be over a period of time to maintain the target downhole pressure having the target downhole wave shape as desired and described herein.

Examples of various wave shapes applicable to the present disclosure, whether surface, downhole, or target downhole wave shapes may include, but are not limited to, a square wave shape, a sine wave shape, a sawtooth wave shape, a triangle wave shape, a rectangle wave shape, a custom wave shape, and any combination thereof. That is, a portion of the pressure wave, whether surface, downhole, or target downhole wave, may have a portion that is one wave shape and a portion that is one or more other wave shapes, which may be altered over time by adjusting the surface pressure, as described herein.

As used herein, the term "square wave shape," and grammatical variants thereof, refers to a non-sinusoidal periodic waveform represented by a combination of various waveforms (e.g., an infinite summation of sinusoidal waves) having an amplitude that alternates at a steady frequency between fixed minimum and fixed maximum values and a fixed duration at the minimum and maximum altitude values (i.e., forming square wave shapes). The term "sawtooth wave shape," as used herein, and grammatical variants thereof, refers to a non-sinusoidal periodic waveform having sharp slanted ramps upward and sharp drops, or sharp slanted ramps downward and sharp drops. The term "triangle wave shape," as used herein, and grammatical variants thereof, refers to a non-sinusoidal periodic waveform having sharp slanted ramps upward and sharp slanted ramps downward, or sharp slanted ramps downward and sharp slanted ramps upward (i.e., forming triangle wave shapes). As used herein, the term "rectangle wave shape," and grammatical variants thereof, refers to a non-sinusoidal periodic waveform having an amplitude that alternates at a steady frequency between fixed minimum and fixed maximum values, but a varying duration at the minimum and maximum altitude values (i.e., forming rectangle wave shapes). These square, sawtooth, triangle, and rectangle wave shapes are deemed herein "standard wave shapes." The term "custom wave shape," as used herein, and grammatical variants thereof, refers to a non-standard wave shape, which may vary in any of amplitude, duration, and periodicity compared to the other wave shapes described herein. The custom wave shape may, for example, be an irregular wave shape, or a combination of standard wave shapes forming a non-standard wave shape, or a combination of irregular wave shapes forming a non-standard wave shape, or a series of standard and/or irregular wave shapes forming a non-standard wave shape for a particular period. Such custom wave shapes may, for example, be corrupted by noise or delayed signals.

Accordingly, the embodiments of the present disclosure use surface and downhole pressure wave shapes to adjust the surface pressure continuously, on demand, in pulses, and by any other iteration (e.g., adjust pump rate, turn off and rapidly back on pump rate to apply a pulse, and the like), to achieve a desired downhole target pressure having a target downhole wave shape. The target downhole wave shape may be selected to maximize a stimulation or production operation. That is, the target downhole wave shape may be used to glean a characteristic of a stimulation or production operation to increase fracture volume, increase fracture complexity, and the like. The frequency, in some embodiments, of the pressure waves and wave shapes may be used such as to excite natural acoustic frequency inside of a formation to enhance fracture propagation therein.

Advantages of the embodiments described herein may include, but are not limited to, increasing production of a particular subterranean formation (i.e., wellbore) by using surface pressure pulses generated by, for example, pump rate variation compared to steady pump pressures; increasing production by using surface pressure variations without affecting the amount of fluid, fracturing particulates, and/or proppant particulates in a treatment fluid; increased seismic activity with surface pressure variations which is indicative of increased fracture complexity compared to conventional steady pump rate fracturing; the surface pressure may be decreased in various fracture stages when surface pump rate variations are applied; and surface pressure variations to achieve desired downhole pressures can be applied to multiple treatment fluids types employed during a stimulation operation (e.g., pad treatment fluid, proppant treatment fluid, and the like).

The present disclosure accordingly does not merely provide a means of varying surface pressures (e.g., pump rates) to alter downhole pressures during stimulation treatments using constant surface pump rate changes or mere pressure pulses, but the controlled determination of wave shapes and their comparison to increase fracture volume using effective downhole pressures.

For example, referring now to FIG. 1, illustrated is a graphical representation of the impact of increasing fracture volume on sinusoidally surface and downhole pressure wave shape amplitudes, according to one or more embodiments described herein. FIG. 1 illustrates that as the volume of a fracture or fracture network increases, the surface pressure at a surface location must be increased (e.g., to achieve a surface pressure wave having a surface wave shape of greater amplitude or frequency) to achieve a constant or near constant (i.e., identical or near identical) downhole pressure wave and wave shape (e.g., the target downhole pressure wave and wave shape). As shown in FIG. 1, two sets of sinusoidal surface wave shapes and sinusoidal downhole shapes are compared, termed herein "wave couplet 1" and "wave couplet 2." Wave couplet 1 represents a small fracture volume and has a sinusoidal surface wave shape 1 having an amplitude of about +/−178 generalized pressure units (GPU) to achieve a sinusoidal, normalized downhole wave shape 1 having an amplitude of about +/−100 GPU. As used herein, the terms "generalized pressure unit" or "GPU," and grammatical variants thereof, refers to any pressure unit. That is, a GPU is a generalized term used to represent any pressure unit for illustrative purposes (e.g., pascals, pound per square inch, and the like). As the fracture volume increases, however, as occurs overtime during a stimulation operation of a subterranean formation (e.g., a fracturing operation in which a treatment fluid is introduced above a fracture gradient over time), as represented by wave couplet 2. Wave couplet 2 represents a larger fracture volume (compared to wave couplet 1) and has a sinusoidal surface wave shape 2 having an amplitude of about +/−315 GPU to achieve a sinusoidal, normalized downhole wave shape 2 having an amplitude of about +/−100 GPU, which is constant or near constant relative to downhole wave shape 1. Accordingly, to achieve the same, or constant or near constant, downhole pressure wave requires increasing surface pressure as fracture volume increases, and may be taken into account when seeking the target downhole pressure wave and wave shape.

In some embodiments, accordingly, the treatment fluid is introduced into the subterranean formation (e.g., through a wellhead) at the surface pressure above the fracture gradient of the formation to create or enhance the at least one fracture, and as the treatment fluid is introduced the volume of the at least one fracture increases. The downhole pressure wave and wave shape, as well as the surface pressure wave and wave shape are determined and compared. And, in response to the increase in the volume of the at least one fracture, the adjusting of the surface pressure at the surface location is made to maintain the target downhole wave shape over a period of time. For example, as shown in FIG. 1, the surface pressure may be increased (singly, continually, or stepwise in intervals over time) as the volume of the at least one fracture increases to maintain a constant or near constant target downhole pressure wave and wave shape during the period of time which the at least one fracture is increasing. In other embodiments, depending on various factors, such as the nature of the formation, the nature of the desired downhole pressure wave and shape, the surface pressure may be decreased (singly, continually, or stepwise in intervals over time), or alternatingly decreased and increased periodically in any pattern to achieve a constant or near constant target downhole pressure wave and shape over time as the volume of the at least one fracture increases.

As used herein, the term "near constant," and grammatical variants thereof, with reference to maintaining target downhole pressure waves and downhole pressure wave shapes refers to a no more than about 10% (e.g., no more than about 5% to about 10%) difference in pressure. Accordingly, the methods and systems of the present disclosure allow for maintenance of a constant or near constant target downhole pressure waves and wave shapes as the fracture volume increases.

Figure 2:
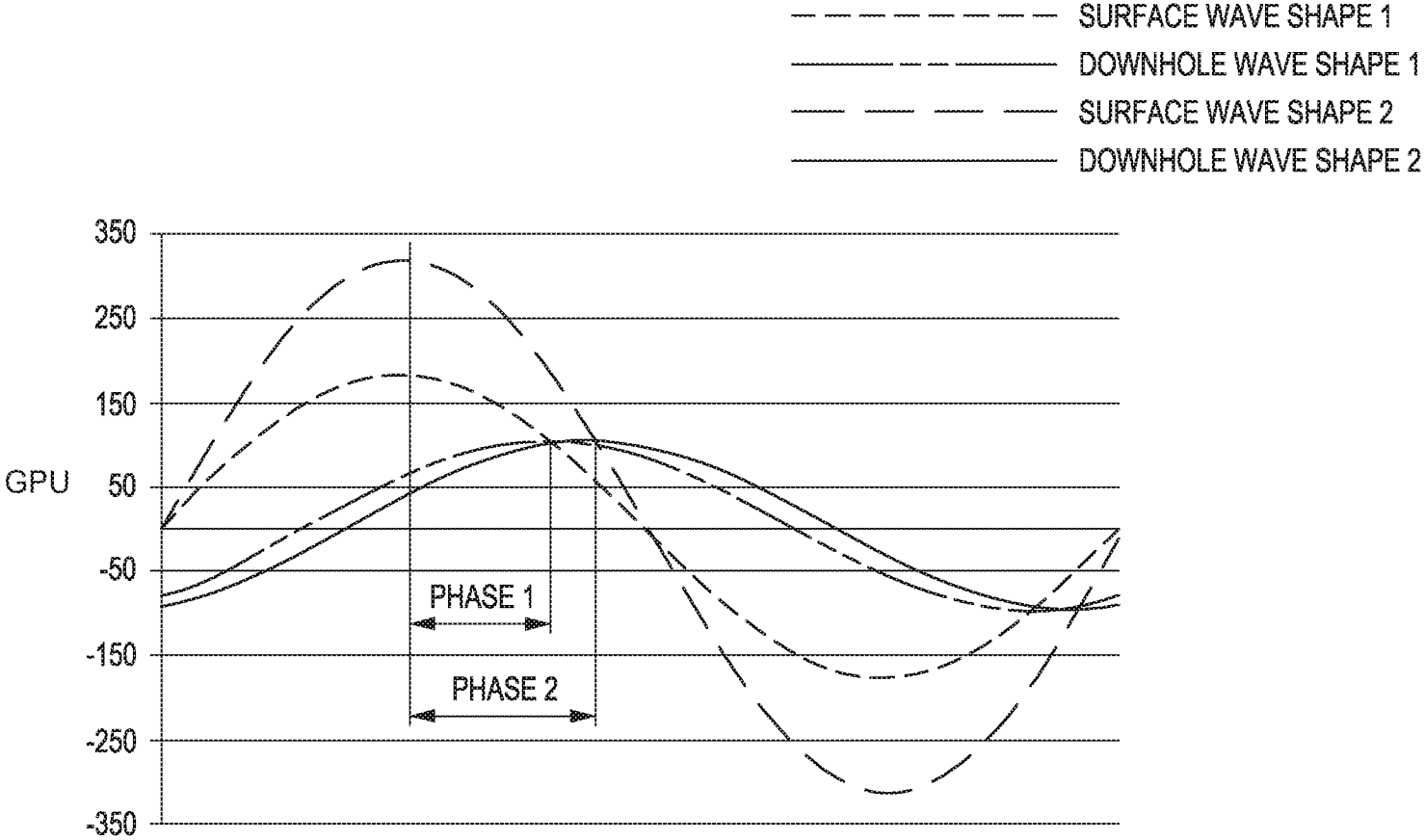
FIG. 2 illustrates a graphical representation of the impact of increasing fracture volume on sinusoidally surface and downhole pressure wave shape phase changes, according to one or more embodiments of the present disclosure.

Referring now to FIG. 2, illustrated is a graphical representation of the impact of increasing fracture volume on sinusoidally surface and downhole pressure wave phase changes, according to one or more embodiments described herein. FIG. 2 is a close up of a portion of FIG. 1, illustrating that as the volume of a fracture increases during a stimulation operation, the size of the phase change between the surface wave shape and the downhole wave shape increases. As shown, wave couplet 2, having a larger fracture volume after a period of time during a stimulation operation exhibits a larger phase change as compared to wave couplet 1, having a smaller fracture volume because it is earlier in time during a stimulation operation. To maintain constant or near constant target downhole pressure waves and wave shapes changes throughout an operation, therefore, the surface pressure may be adjusted to ensure that the phase change remains constant or near constant during the duration of a stimulation operation, regardless of the volume change (e.g., increase) of a fracture or fracture network.

Accordingly, as it may be important in one or more embodiments of the present disclosure to increase the surface pressure as the volume of a fracture (or fracture network) increases to maintain a constant or near constant target downhole wave shape over time, and it may additionally be beneficial to adjust the surface pressure to maintain a constant or near constant phase change of the target downhole pressure wave. In so doing, either one or the combination of maintaining the target downhole wave shape constant or near constant and/or the phase change constant or near constant will allow for optimization of surface pressure to ensure constant or near constant target downhole pressures throughout a stimulation operation as fracture volume increases.

Figure 3:
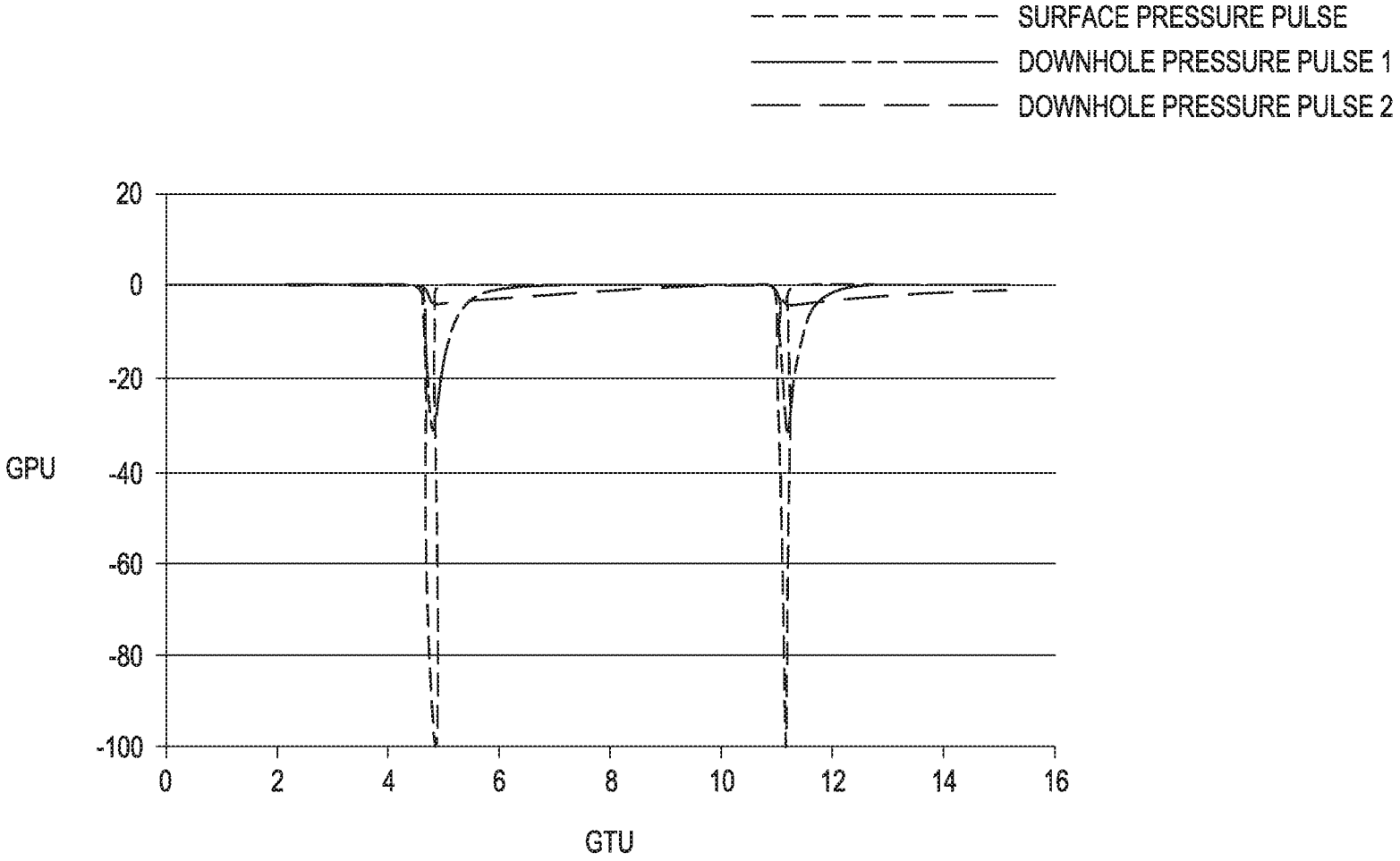
FIG. 3 illustrates the effect of a surface pressure pulse change as the volume of a fracture increases, according to one or more embodiments of the present disclosure.

Referring now to FIG. 3, illustrated is the effect of a surface pressure pulse change as the volume of a fracture increases, according to one or more embodiments. As shown in FIG. 3, two downhole pressure pulses are depicted: downhole pressure pulse 1 represents the effect of the surface pressure pulse at an earlier time during a stimulation operation (e.g., fracture volume is relatively small); downhole pressure pulse 2 represents the effect of the same surface pressure pulse applied to achieve downhole pressure pulse 1, but at a time later in the stimulation operation such that the fracture volume is larger than when the surface pressure pulse is applied to achieve downhole pressure pulse 1. As shown, downhole pressure pulse 1 reaches about −30 GPU, whereas downhole pressure pulse 2 reaches about −5 GPU. The x-axis is generalized time units (GTU). As used herein, the terms "generalized time unit" or "GTU," and grammatical variants thereof, refers to any time unit. That is, a GTU is a generalized term used to represent any time unit for illustrative purposes (e.g., seconds, minutes, hours, and the like). As seen, the effect of the same surface pressure pulse is less effective over time, as represented by downhole pressure pulse 2 as compared to downhole pressure pulse 1.

As seen in FIG. 3, the surface pressure pulse (e.g., applied into a wellhead) is represented by a spike, which may be drastically attenuated before reaching one or more fractures. Accordingly, as provided in the embodiments described herein, the consequential downhole pressure wave may be determined (e.g., measured, calculated, modeled, and the like) to determine the intensity or duration of the surface pressure pulse required to maintain constant or near constant the target downhole pressure wave and wave shape throughout a stimulation operation (i.e., as fracture volume increases).

Surface pressure pulses may additionally be used to offset capillary pressures and aid in the dilation of microfractures (i.e., smaller fractures extending from larger fractures, the larger fractures of which may extend directly from a wellbore) and natural fractures already in existence to increase exposed contact area in the fracture system to increase productivity. Surfactant chemistries in the treatment fluids used may further increase production, whether relying on pressure pulses and/or other means of adjusting the surface pressure to achieve desired target pressure waves and wave shapes.

In some embodiments, modeling may aid in determining how much fracture dilation (e.g., volume increase) influences stress within the formation and/or fracture such that a constant stress condition rather than a constant downhole pressure wave or wave shape may be maintained by adjusting the surface pressure (e.g., rate, pulse, and the like). That is, in some instances, modeling or other means may demonstrate that increasing, decreasing, or alternating between increasing and decreasing the target downhole pressure wave frequency, amplitude, duration, phase change, and/or wave shape itself may beneficially increase fracture volume, complexity, inner-connectivity, or other parameters that contribute to increased production of hydrocarbons. In such instances, accordingly, the surface pressure may not be adjusted merely to maintain a constant or near constant target downhole pressure wave and wave shape, but rather to achieve a particular target (e.g., optimal or desired) stress profile, which may result in a target changing downhole pressure wave and/or wave shape overtime.

In yet other embodiments, modeling may be used to aid in determining whether the surface pressure should be adjusted to obtain a target downhole pressure or pressure wave that is different than that of the surface pressure wave and wave shape. That is, the surface pressure may be adjusted to achieve a desired target downhole pressure wave and wave shape that is the same as the surface pressure wave and wave shape, or wholly different in frequency, amplitude, duration, phase change, and/or wave shape itself to achieve increased fracture volume, complexity, interconnectivity, and the like to increase hydrocarbon production.

Accordingly, the present disclosure provides embodiments related to altering surface pressure upon observation of the surface pressure wave and wave shape and a downhole pressure wave and wave shape, and adjustment of the surface pressure to achieve a desired target downhole pressure wave having a particular wave shape or combination of wave shapes. In some embodiments, as a fracture (or fracture network) increases in volume as a treatment fluid is introduced into a subterranean, such as during a stimulation (e.g., fracturing) operation, the surface pressure is adjusted to maintain constant or near constant the target downhole pressure wave and wave shape. In some embodiments, as a fracture (or fracture network) increases in volume as a treatment fluid is introduced into a subterranean, such as during a stimulation (e.g., fracturing) operation, the surface pressure is adjusted to alter the target downhole pressure wave and wave shape such that it is not maintained constant but is adjusted in wave properties (e.g., amplitude, frequency, duration, periodicity, and the like) or in wave shape, either wholly or partially to optimize production of the formation.

In certain embodiments, the surface pressure is adjusted at the surface location such that the target downhole wave shape matches the surface wave shape, regardless of whether the volume of the fracture is increasing. In other embodiments, the surface pressure is adjusted at the surface location such that the target downhole wave shape is different than the surface wave shape, regardless of whether the volume of the fracture is increasing; or such that the target downhole wave shape is different than the particular aspects of the surface wave shape, regardless of whether the volume of the fracture is increasing. For example, the target downhole wave shape and the surface wave shape may be both sinusoidal, but the surface pressure is adjusted to make the amplitude, frequency, duration, periodicity, and the like different between the target downhole wave shape and the surface wave shape. In such embodiments, the wave shapes may be said to be the same, but the wave properties of the two wave shapes are different.

In certain embodiments, as discussed above, the surface pressure is adjusted at the surface location to preferably ensure that the frequency of the target downhole wave shape is maintained at constant or near constant over a period of time, which may be over an entire formation operation (e.g., fracturing operation) or only a certain duration of the formation operation after which a different frequency, wave shape, or other wave shape properties are adjusted by adjusting the surface pressure. That is, the surface pressure can be adjusted on demand upon determining that a target downhole wave shape is desirably altered either to a new wave shape, different wave shape properties, and the like. For example, if it is determined that the frequency of the downhole pressure wave shape is deviating from the target downhole pressure wave and wave shape, the surface pressure may be immediately adjusted at the surface location to achieve the desired target downhole wave shape having the desired target frequency. Such "on demand" adjustment of the surface pressure ensures that target downhole pressure waves and target downhole wave shapes may be maintained over the duration of a formation operation, as desired for the particular operation and formation properties, which may be used to realize consistent fracture complexity degree and growth throughout the entire operation.

Adjustment of the surface pressure at the surface location, accordingly, may be achieved by any processes including, but not limited to, a pressure pulse, decreasing the surface pressure, increasing the surface pressure or otherwise alternating between increasing, decreasing, and/or applying pressure pulses. In some embodiments, the surface pressure is adjusted by applying an electric spark to achieve the desired target downhole pressure wave having the target downhole shape. Any means of applying electric spark technology, such as using the spark creator 440 (see FIG. 4), may be used in accordance with the embodiments described herein to achieve the desired target downhole wave shape. As used herein, the term "electric spark" refers to an abrupt electrical discharge caused when a high electric field creates and ionized, electrically conductive channel through a treatment fluid medium (such fluids including liquids, gases, and combinations thereof). That is, the electric spark may be created by an electric field transmitted from a surface location to alter the surface pressure and create the target downhole pressure wave and wave shape.

Figure 4:
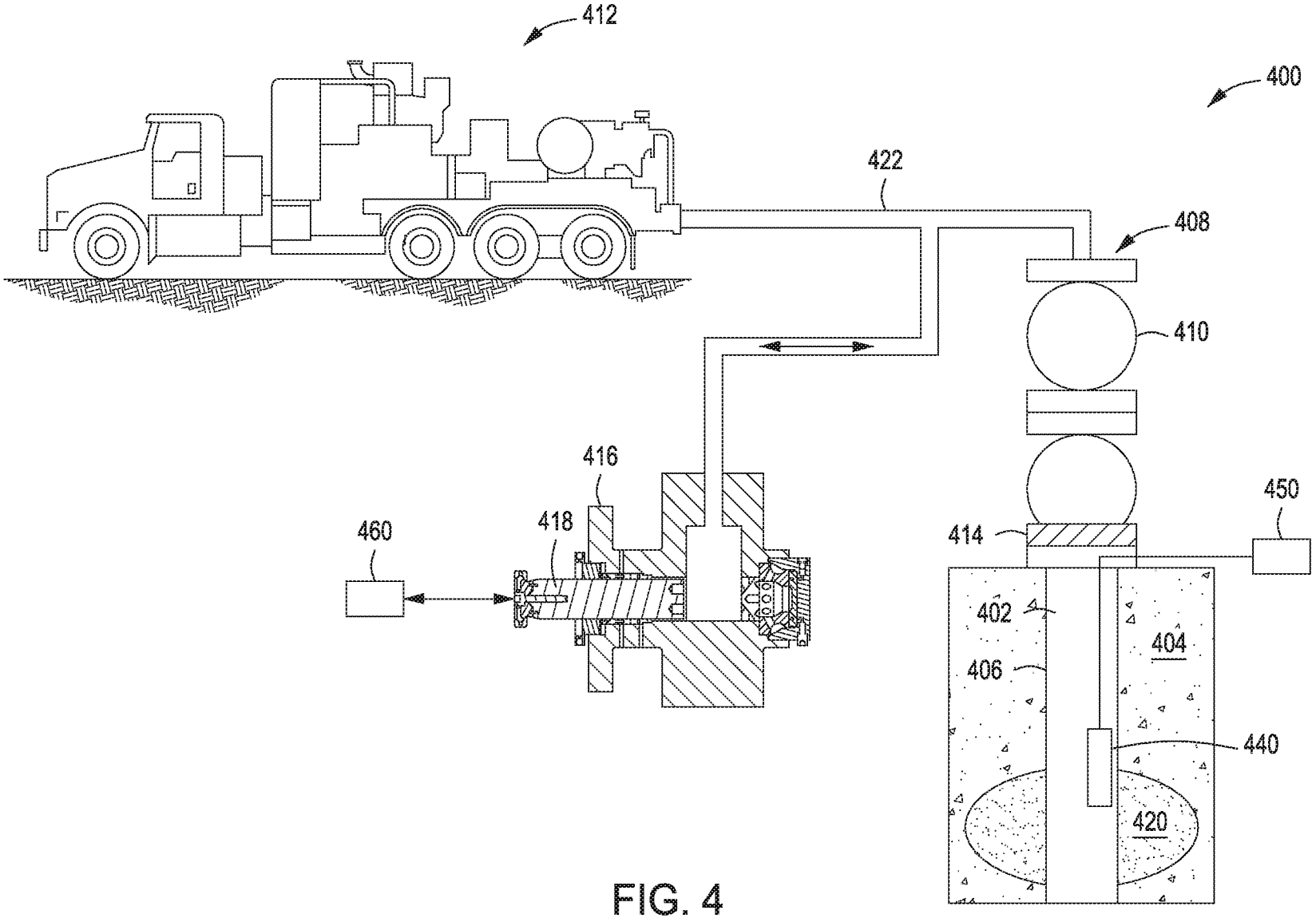
FIG. 4 illustrates a system configured for adjusting the surface pressure at a surface location to achieve a target downhole pressure wave and target downhole pressure wave shape, according to one or more embodiments of the present disclosure.

Referring now to FIG. 4, in some embodiments, a pulsing system 400 is provided by the present disclosure that may comprise at least one surface pump 412 configured to pump a treatment fluid at a surface location, represented in FIG. 4 as a frac pump(s) on a truck. It will be appreciated, however, that the surface pump 412 may be any well service pump suitable for use in a subterranean formation operation in any form, without departing from the scope of the present disclosure. In some embodiments, the system 400 further comprises at least one plunger-type pump 416 (also referred to as a pulsing pump) located at the surface location (at any surface location as defined herein, including at or near the surface pump(s) 412), which may comprise a plunger 418 that is reciprocated by a plunger driver 460. As used herein, the term "plunger-type pump," and grammatical variants thereof, refers to a reciprocating pump (e.g., generally many high pressure pumps) that uses a plunger driver (or piston driver) to move media through a cylindrical body. The plunger driver 460 may be any structure capable of reciprocating the plunger 418 of the plunger-type pump 416, without departing from the scope of the present disclosure, and may additionally control velocity of the reciprocating plunger 418. Preferably, the plunger-type pump 416 lacks suction and discharge valves.

Accordingly, the surface pressure may be adjusted simply by reciprocation of the plunger-type pump, which may be used alone to alter the downhole pressure wave and wave shape to achieve a target downhole pressure wave and wave shape. For example, as the plunger 418 of the plunger-type pump 416 is reciprocated backwards or "retracted" (to the left in FIG. 4), flowrate may decrease and influence pressure and wave shape; as the plunger 418 of the plunger-type pump 416 is reciprocated inwards or "extended" (to the right in FIG. 4), flowrate may increase and influence pressure and wave shape. In other embodiments, the combination of an adjustment of the surface pump 412, or other means of pressure adjustment at the surface location, as well as the reciprocation of the plunger-type pump 416 is used to adjust the surface pressure to achieve the desired target downhole pressure wave and wave shape, without departing from the scope of the present disclosure.

With continued reference to FIG. 4, the system 400 is configured for adjusting the surface pressure at a surface location to achieve a target downhole pressure wave and target downhole pressure wave shape, according to one or more embodiments of the present disclosure. It will be appreciated that although the system described below and depicted in FIG. 4 generally references a land-based system, like systems may be operated in subsea locations as well, without departing from the scope of the present disclosure.

As shown, system 400 includes a wellbore 402 drilled through subterranean formation 404 to access a hydrocarbon reservoir, for example. It is to be appreciated that the system 400 (and the methods provided herein) are applicable to wellbores at any angle including, but not limited to, vertical wells, deviated wells, highly deviated wells, horizontal wells, and hybrid wells comprising sections of any combination of the aforementioned wells. As used herein, the term "deviated wellbore" refers to a wellbore in which any portion of the well that is oriented between about 55-degrees and about 125-degrees from a vertical inclination. As used herein, the term "highly deviated wellbore" refers to a wellbore that is oriented between about 75-degrees and about 105-degrees off-vertical. In some embodiments, a subterranean formation and wellbore may be provided with an existing fracture network.

A tubular 406 extends into wellbore 402 from wellhead 408. The tubular 406 may be a casing string, drill string, or other tubular which may be used to form an annulus between the interior diameter of the wellbore 402 and the exterior diameter of the tubular 406, which may be filled with a cured cement slurry (i.e., forming a cement sheath), without departing from the scope of the present disclosure. In other embodiments, one or more portions of the wellbore 402 may or may not have the tubular 406 cemented therein or may or may not have a tubular 406 extending the entirety of the wellbore 402 (e.g., uncased portions), without departing from the scope of the present disclosure. As shown, valve(s) 410 may further be attached to the wellhead 408 to control the flow of fluids (e.g., treatment fluids and/or produced fluids, including liquid and gaseous phases) from the wellbore 402. One or more blowout preventers 414, such as tubing type or shear type, may also be attached to the wellhead 408 to control the wellbore 402 in case of catastrophic situations, without departing from the scope of the present disclosure.

The surface pump unit(s) 412 may be connected to wellhead 408, which extends into the wellbore 402. Such surface pump unit(s) 412 located at a surface location may provide the primary flow into the wellbore 402 to create, extend, or enhance at least one fracture 420 in the formation 404. Additionally, a plunger-type pump(s) 416 may also be located at a surface location and may be attached to output line(s) 422 of the surface pump unit(s) 412 that connects to the wellhead 408. The plunger-type pump(s) 416 reciprocates by reciprocating the plunger 418 in the interior of the plunger-type pump 416. The reciprocation may be used to alter downhole pressure waves and wave shapes, such as by increasing surface pressure as the as the plunger 418 is reciprocated inwards or "extended" (to the right in FIG. 4), or decreasing surface pressure as the plunger 418 is reciprocated backwards or "retracted" (to the left in FIG. 4).

The output of the surface pump unit(s) 412 may be adjusted (e.g., adding a frequency, increasing or decreasing in frequency, increasing or decreasing in reciprocation depth, and the like) by increasing or decreasing reciprocation of the plunger 418 of the plunger-type pump 416 to affect the pressure exerted downhole on a treatment fluid to achieve the target downhole pressure wave and wave shape, for example. Accordingly, these adjustments of the surface pump unit(s) 412 by use of the plunger-type pump(s) 416 will adjust the average surface pressure, thereby allowing achievement of the target downhole pressure wave and wave shape, for example.

The plunger-type pump 416 may additionally provide pump rate (e.g., control fluid) by itself acting as a high-pressure pump or a low-pressure pump, such that adjustment of the surface pressure may be achieved by adjusting the pressure directly applied by the surface pump unit 412, by the reciprocation or adjustment thereof of the plunger 418 alone, or any combination thereof, without departing from the scope of the present disclosure. Accordingly, the surface pump unit 412 and/or the plunger-type pump 416 may be high pressure or low pressure pumps to achieve the desired surface pressure adjustments to achieve the target downhole pressure waves and wave shapes. As used herein, the term "high pressure pump," and grammatical variants thereof, refers to a pump that is capable of delivering a fluid downhole at a pressure of about 1000 psi or greater; the term "low pressure pump," and grammatical variants thereof, refers to a pump that operates at a pressure of about 1000 psi or less. In preferred embodiments, the surface pump unit 412 and/or the plunger-type pump 416 are high pressure pumps.

In some embodiments, the plunger-type pump 416 is preferably a long-stroke plunger-type pump. As used herein, the term "long-stroke plunger-type pump," and grammatical variants thereof, refers to high-pressure plunger-type pumps having no valves and relatively long plungers (e.g., plunger 418) compared to traditional plunger-type pumps. Examples of suitable commercially available long-stroke plunger-type pumps include, but are not limited to the HT-1000™ and HT-3000™ Intensifier Pumps with their valves removed, available from Halliburton Energy Services, Inc. in Houston, Tex. The long-stroke plunger-type pumps having no valves are able to follow the pressure levels provided by the surface pump(s) 412. The plunger-type pump(s) 416, whether or not classified as a long-stroke plunger-type pump(s), can be driven by plunger driver 460 that is hydraulically actuated, electromagnetically actuated, mechanically actuated, and the like. For example, hydraulically actuated plunger drivers allow for any length of stroke that is less than and up to the maximum stroke length. If the plunger driver 460 is a mechanical rotary crank system, on the other hand, the length of the stroke is constant, and thus the flow output pressure wave shape is sinusoidal. In some embodiments, the plunger driver 460 may be integral to the plunger-type pump 416, or external. For example, the HT-1000™ and HT-3000™ Intensifier Pumps have hydraulically actuable driver shafts or plunger (that is larger for intensification) that are integral to the pump unit. These large plungers are in turn driven by large hydraulic pumps. This is especially true when the plunger-type pump 416 is a long-stroke plunger-type pump.

In some embodiments, to achieve the desired target downhole pressure wave having the target downhole wave shape (e.g., requiring alteration of the initial downhole wave shape and/or initial surface wave shape), multiple plunger-type pumps 416 are used, each able to achieve different frequencies (e.g., by the length of the stroke). Accordingly, because of the multitude of different frequencies, one or more or all of the plunger-type pump(s) 416 may be stroked a certain length to alter or change an initial downhole wave shape to achieve the desired target downhole wave shape. In some embodiments, as discussed above, the use of electrical sparks created by a spark creator 440 may be used to create short, high intensity pulses to provide control to alter or change downhole pressure waves and wave shapes. The spark creator 440 may be powered externally by a high voltage source 450.

It is to be recognized that system 400 is merely exemplary in nature and various additional components may be present that have not necessarily been depicted in FIG. 4 in the interest of clarity. Non-limiting additional components that may be present include, but are not limited to, additional surface pumps, supply hoppers, valves, condensers, adapters, joints, gauges, sensors, compressors, pressure controllers, pressure sensors (including pressure wave sensors and pressure wave shape sensors, flow rate controllers, flow rate sensors, temperature sensors, and the like, either at surface or downhole.

It is also to be recognized that the disclosed treatment fluids may also directly or indirectly affect the various downhole equipment and tools that may come into contact with the treatment fluids during operation. Such equipment and tools may include, but are not limited to, wellbore casing, wellbore liner, completion string, insert strings, drill string, coiled tubing, slickline, wireline, drill pipe, drill collars, mud motors, downhole motors and/or pumps, surface-mounted motors and/or pumps, centralizers, turbolizers, scratchers, floats (e.g., shoes, collars, valves, etc.), logging tools and related telemetry equipment, actuators (e.g., electromechanical devices, hydromechanical devices, etc.), sliding sleeves, production sleeves, plugs, screens, filters, flow control devices (e.g., inflow control devices, autonomous inflow control devices, outflow control devices, etc.), couplings (e.g., electro-hydraulic wet connect, dry connect, inductive coupler, etc.), control lines (e.g., electrical, fiber optic, hydraulic, etc.), surveillance lines, drill bits and reamers, sensors or distributed sensors, downhole heat exchangers, valves and corresponding actuation devices, tool seals, packers, cement plugs, bridge plugs, and other wellbore isolation devices, or components, and the like. Any of these components may be included in the systems generally described above and depicted in FIG. 4.

As provided herein, various treatment fluids may be used in accordance with the embodiments of the present disclosure. The treatment fluids may generally comprise a base fluid and one or more additives for performing a particular operation or to achieve desired qualities (e.g., rheology) of the treatment fluid.

Suitable base fluids for use in conjunction with embodiments of the present disclosure may include, but are not limited to, oil base fluids, aqueous base fluids, aqueous-miscible base fluids, water-in-oil emulsion base fluids, oil-in-water emulsion base fluids, and any combination thereof. Suitable oil base fluids may include, but are not limited to, alkanes, olefins, aromatic organic compounds, cyclic alkanes, paraffins, diesel fluids, mineral oils, desulfurized hydrogenated kerosenes, and any combination thereof. Suitable aqueous base fluids may include, but are not limited to, fresh water, saltwater (e.g., water containing one or more salts dissolved therein), brine (e.g., saturated salt water), seawater, produced water (e.g., collected from a subterranean formation), treated or untreated wastewater (e.g., water affected in quality by anthropogenic influence), and any combination thereof. Suitable aqueous-miscible base fluids may include, but are not limited to, alcohols (e.g., methanol, ethanol, n-propanol, isopropanol, n-butanol, sec-butanol, isobutanol, and t-butanol), glycerins, glycols (e.g., polyglycols, propylene glycol, and ethylene glycol), polyglycol amines, polyols, any derivative thereof, any in combination with salts (e.g., sodium chloride, calcium chloride, calcium bromide, zinc bromide, potassium carbonate, sodium formate, potassium formate, cesium formate, sodium acetate, potassium acetate, calcium acetate, ammonium acetate, ammonium chloride, ammonium bromide, sodium nitrate, potassium nitrate, ammonium nitrate, ammonium sulfate, calcium nitrate, sodium carbonate, and potassium carbonate), any in combination with an aqueous-based fluid, and any combination thereof.

Suitable water-in-oil emulsion base fluids, also known as invert emulsions, may have an oil-to-water ratio from a lower limit of greater than about 50:50, 55:45, 60:40, 65:35, 70:30, 75:25, or 80:20 to an upper limit of less than about 100:0, 95:5, 90:10, 85:15, 80:20, 75:25, 70:30, or 65:35 by volume in the base fluid, where the amount may range from any lower limit to any upper limit and encompass any subset therebetween. It is to be appreciated that for water-in-oil and oil-in-water emulsions, any mixture of the above may be used including the water being and/or comprising any of the aqueous base fluids and/or aqueous-miscible base fluids.

To achieve the desired treatment fluid properties and/or for use in a particular subterranean formation operation, a salt, a weighting agent, an inert solid, a fluid loss control agent, an emulsifier, a dispersion aid, a corrosion inhibitor, an emulsion thinner, an emulsion thickener, a viscosifying agent, a gelling agent, a surfactant, a particulate, a proppant, a gravel particulate, a lost circulation material, a foaming agent, a gas, a pH control additive, a breaker, a biocide, a crosslinker, a stabilizer, a chelating agent, a scale inhibitor, a gas hydrate inhibitor, a mutual solvent, an oxidizer, a reducer, a friction reducer, a clay stabilizing agent, and any combination thereof. For example, inclusion of a surfactant additive in the treatment fluids described herein may increase production, whether relying on pressure pulses and/or other means of adjusting the surface pressure to achieve desired target pressure waves and wave shapes.

While various embodiments have been shown and described herein, modifications may be made by one skilled in the art without departing from the scope of the present disclosure. The embodiments described here are exemplary only, and are not intended to be limiting. Many variations, combinations, and modifications of the embodiments disclosed herein are possible and are within the scope of the disclosure. Accordingly, the scope of protection is not limited by the description set out above, but is defined by the claims which follow, that scope including all equivalents of the subject matter of the claims.

Embodiments disclosed herein include:

Embodiment A: A method comprising: (a) introducing a treatment fluid into a subterranean formation at a surface pressure above a fracture gradient of the subterranean formation to create or enhance at least one fracture therein at a first target interval; (b) determining a downhole pressure wave in the subterranean formation, the downhole pressure wave having a downhole wave shape; (c) determining a surface pressure wave at a surface location, the surface pressure wave having a surface wave shape; (d) comparing the downhole wave shape and the surface wave shape; and (e) adjusting the surface pressure at the surface location to achieve a target downhole pressure wave in the subterranean formation, the target downhole pressure having a target downhole wave shape.

Embodiment B: A system comprising: a surface pump configured to pump a treatment fluid at a surface location, a plunger-type pump coupled to an output line of the surface pump, the plunger-type pump comprising a plunger that is reciprocal by a plunger driver and the plunger-type pump lacking suction and discharge valves, and wherein a surface pressure is adjustable by adjusting the surface pump by reciprocating the plunger of the plunger-type pump, or a combination of adjusting the surface pump and reciprocating the plunger of the plunger-type pump to perform the method of: (a) introducing a treatment fluid into a subterranean formation at a surface pressure above a fracture gradient of the subterranean formation to create or enhance at least one fracture therein at a first target interval; (b) determining a downhole pressure wave in the subterranean formation, the downhole pressure wave having a downhole wave shape; (c) determining a surface pressure wave at a surface location, the surface pressure wave having a surface wave shape; (d) comparing the downhole wave shape and the surface wave shape; and (e) adjusting the surface pressure at the surface location to achieve a target downhole pressure wave in the subterranean formation, the target downhole pressure having a target downhole wave shape.

Embodiments A and B may have one or more of the following additional elements in any combination:

Element 1: Further comprising increasing a volume of the at least one fracture as the treatment fluid is introduced, and adjusting the surface pressure at the surface location to maintain the target downhole wave shape over time as the volume of the at least one fracture increases.

Element 2: Further comprising repeating (b) through (e) for a period of time to maintain the target downhole pressure having the target downhole wave shape at the first target interval.

Element 3: Further comprising repeating (a) through (e) at at least a second target interval.

Element 4: Wherein adjusting the surface pressure at the surface location is performed by an adjustment selected from the group consisting of introducing a surface pressure pulse for a period of time, decreasing the surface pressure for a period of time, increasing the surface pressure for a period of time, and any combination thereof.

Element 5: Wherein the surface pressure is adjusted at the surface location such that the target downhole wave shape matches the surface wave shape, or such that the target downhole wave shape is a different wave shape than the surface wave shape.

Element 6: Wherein a wave shape selected from the group consisting of the downhole wave shape, the surface wave shape, the target wave shape, and any combination thereof is selected from the group consisting of a square wave shape, a sine wave shape, a sawtooth wave shape, a triangle wave shape, a rectangle wave shape, a custom wave shape, and any combination thereof.

Element 7: Further comprising adjusting the surface pressure at the surface location using an electric spark to achieve the target downhole pressure wave having the target downhole wave shape.

Element 8: Wherein the surface pressure is adjusted at the surface location such that the target downhole wave shape has a frequency that is maintained constant or near constant for a period of time.

Element 9: Wherein the surface pressure is adjusted at the surface location such that the target downhole wave shape has a frequency that is adjustable on demand to a different frequency.

Element 10: Wherein when a plunger-type pump is used, when the plunger is extended the surface pressure increases, and when the plunger is retracted the surface pressure decreases.

Element 11: Wherein when a plunger-type pump is used, the plunger-type pump is a long-stroke plunger-type pump.

By way of non-limiting example, exemplary combinations applicable to A and/or B include: 1-11; 1, 3, and 5; 2 and 8; 1, 2, 4, 8, 9, and 11; 10 and 11; 3, 4, and 7; 8 and 10; 2, 3, 6, 7, and 9; 4 and 6; 3, 7, and 11; 9 and 11; 1, 5, and 6; and any non-limiting combination of two, more than two, or all of 1-11.

Therefore, the embodiments disclosed herein are well adapted to attain the ends and advantages mentioned as well as those that are inherent therein. The particular embodiments disclosed above are illustrative only, as they may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered, combined, or modified and all such variations are considered within the scope and spirit of the present disclosure. The embodiments illustratively disclosed herein suitably may be practiced in the absence of any element that is not specifically disclosed herein and/or any optional element disclosed herein. While compositions and methods are described in terms of "comprising," "containing," or "including" various components or steps, the compositions and methods can also "consist essentially of" or "consist of" the various components and steps. All numbers and ranges disclosed above may vary by some amount.

Whenever a numerical range with a lower limit and an upper limit is disclosed, any number and any included range falling within the range is specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an," as used in the claims, are defined herein to mean one or more than one of the element that it introduces.

What is claimed is:

1. A method comprising:

(a) introducing a treatment fluid into a subterranean formation at a surface pressure above a fracture gradient of the subterranean formation to create or enhance at least one fracture therein at a first target interval;

(b) determining a downhole pressure wave in the subterranean formation, the downhole pressure wave having a downhole wave shape;

(c) determining a surface pressure wave at a surface location, the surface pressure wave having a surface wave shape;

(d) comparing the downhole wave shape and the surface wave shape;

(e) adjusting a pump rate of a surface pump by reciprocating a plunger of a plunger-type pump, or in a combination of adjusting the surface pump and reciprocating the plunger of the plunger-type pump, wherein the surface pump and the plunger-type pump are different pumps; and (f) adjusting the surface pressure at the surface location to achieve a target downhole pressure wave in the subterranean formation, the target downhole pressure having a target downhole wave shape.

2. The method of claim 1, further comprising increasing a volume of the at least one fracture as the treatment fluid is introduced, and adjusting the surface pressure at the surface location to maintain the target downhole wave shape over time as the volume of the at least one fracture increases.

3. The method of claim 1, further comprising repeating (b) through (e) for a period of time to maintain the target downhole pressure having the target downhole wave shape at the first target interval.

4. The method of claim 1, further comprising repeating (a) through (e) at at least a second target interval.

5. The method of claim 1, wherein adjusting the surface pressure at the surface location is performed by an adjustment selected from the group consisting of introducing a surface pressure pulse for a period of time, decreasing the surface pressure for a period of time, increasing the surface pressure for a period of time, and any combination thereof.

6. The method of claim 1, wherein the surface pressure is adjusted at the surface location such that the target downhole wave shape matches the surface wave shape, or such that the target downhole wave shape is a different wave shape than the surface wave shape.

7. The method of claim 1, wherein a wave shape selected from the group consisting of the downhole wave shape, the surface wave shape, the target downhole wave shape, and any combination thereof is selected from the group consisting of a square wave shape, a sine wave shape, a sawtooth wave shape, a triangle wave shape, a rectangle wave shape, a custom wave shape, and any combination thereof.

8. The method of claim 1, further comprising adjusting the surface pressure at the surface location using an electric spark to achieve the target downhole pressure wave having the target downhole wave shape.

9. The method of claim 1, wherein the surface pressure is adjusted at the surface location such that the target downhole wave shape has a frequency that is maintained constant or near constant for a period of time.

10. The method of claim 1, wherein the surface pressure is adjusted at the surface location such that the target downhole wave shape has a frequency that is adjustable on demand to a different frequency.

11. A system comprising:

a surface pump configured to pump a treatment fluid at a surface location, a plunger-type pump coupled to an output line of the surface pump, the plunger-type pump comprising a plunger that is reciprocal by a plunger driver and the plunger-type pump lacking suction and discharge valves, and wherein a surface pressure is adjustable by adjusting the surface pump by reciprocating the plunger of the plunger-type pump, or a combination of adjusting the surface pump and reciprocating the plunger of the plunger-type pump to perform the method of:

(a) introducing a treatment fluid into a subterranean formation at a surface pressure above a fracture gradient of the subterranean formation to create or enhance at least one fracture therein at a first target interval;

(b) determining a downhole pressure wave in the subterranean formation, the downhole pressure wave having a downhole wave shape;

(c) determining a surface pressure wave at a surface location, the surface pressure wave having a surface wave shape;

(d) comparing the downhole wave shape and the surface wave shape; and (e) adjusting the surface pressure at the surface location to achieve a target downhole pressure wave in the subterranean formation, the target downhole pressure having a target downhole wave shape.

12. The system of claim 11, wherein when the plunger is extended the surface pressure increases, and when the plunger is retracted the surface pressure decreases.

13. The system of claim 11, wherein the plunger-type pump is a long-stroke plunger-type pump.

14. The system of claim 11, further comprising increasing a volume of the at least one fracture as the treatment fluid is introduced, and adjusting the surface pressure at the surface location to maintain the target downhole wave shape over time as the volume of the at least one fracture increases.

15. The system of claim 11, wherein adjusting the surface pressure at the surface location is performed by an adjustment selected from the group consisting of introducing a surface pressure pulse for a period of time, decreasing the surface pressure for a period of time, increasing the surface pressure for a period of time, and any combination thereof.

16. The system of claim 11, wherein the surface pressure is adjusted at the surface location such that the target downhole wave shape matches the surface shape, or such that the target downhole wave shape is a different wave shape than the surface wave shape.

17. The system of claim 11, wherein a wave shape selected from the group consisting of the downhole wave shape, the surface wave shape, the target downhole wave shape, and any combination thereof is selected from the group consisting of a square wave, a sine wave, a sawtooth wave, a triangle wave, a rectangle wave, a custom wave shape, and any combination thereof.

18. The system of claim 11, further comprising adjusting the surface pressure at the surface location using an electric spark to achieve the target downhole pressure wave having the target downhole wave shape.

19. The system of claim 11, wherein the surface pressure is adjusted at the surface location such that the target downhole wave shape has a frequency that is maintained constant or near constant for a period of time.

20. The system of claim 11, wherein the surface pressure is adjusted at the surface location such that the target downhole wave shape has a frequency that is adjustable on demand to a different frequency.

* * * * *